US007416033B2

(12) United States Patent
Hinshaw et al.

(10) Patent No.: US 7,416,033 B2
(45) Date of Patent: Aug. 26, 2008

(54) INSTRUMENTED DRILL HEAD, RELATED DRILLING/BOLTING MACHINES, AND METHODS

(75) Inventors: Gregory E. Hinshaw, Proctorville, OH (US); Henry E. Wilson, Ironton, OH (US); William G. Kendall, Jr., Spanish Fork, UT (US)

(73) Assignee: J.H. Fletcher & Co., Huntington, WV (US)

( * ) Notice: Subject to any disclaimer, the term of this patent is extended or adjusted under 35 U.S.C. 154(b) by 121 days.

(21) Appl. No.: 10/561,779

(22) PCT Filed: Jul. 6, 2004

(86) PCT No.: PCT/US2004/021928

§ 371 (c)(1),
(2), (4) Date: Dec. 20, 2005

(87) PCT Pub. No.: WO2005/008017

PCT Pub. Date: Jan. 27, 2005

(65) Prior Publication Data

US 2007/0144781 A1 Jun. 28, 2007

Related U.S. Application Data

(60) Provisional application No. 60/485,566, filed on Jul. 8, 2003.

(51) Int. Cl.
*E21B 47/00* (2006.01)

(52) U.S. Cl. ..... 175/40; 175/24; 175/27; 175/122; 175/162

(58) Field of Classification Search ..... 175/40, 175/24, 27, 122, 162
See application file for complete search history.

(56) References Cited

U.S. PATENT DOCUMENTS

| | | | | |
|---|---|---|---|---|
| 3,032,129 | A | 5/1962 | Fletcher et al. | |
| 4,190,116 | A | 2/1980 | O 'Neal et al. | |
| 4,957,171 | A | 9/1990 | Morrison et al. | |
| 6,035,951 | A | 3/2000 | Mercer et al. | |
| 6,315,062 | B1 * | 11/2001 | Alft et al. | 175/45 |
| 2001/0022238 | A1 | 9/2001 | Houwelingen et al. | |
| 2002/0157870 | A1 | 10/2002 | Bischel et al. | |

* cited by examiner

*Primary Examiner*—Giovanna C Wright
(74) *Attorney, Agent, or Firm*—King & Schickli, PLLC

(57) ABSTRACT

In one aspect, the invention comprises an instrumented drill head for intended use with a drilling machine including a drilling element, such as a drill bit. The drill head includes a case with a rotatable chuck for the drilling element. A first sensor associated with the drill head senses and generates an output signal representative of a first parameter of the drilling operation. A transmitter wirelessly transmits the signal to a receiver associated with a controller. A roof bolting machine including the drill head and a resin inserter is also disclosed, as are related methods of instrumenting a drill head and drilling using an instrumented drill head.

23 Claims, 12 Drawing Sheets

INSTRUMENTED DRILL HEAD, RELATED DRILLING/BOLTING MACHINES, AND METHODS

This application claims the benefit of U.S. Provisional Patent Application Ser. No. 60/485,566, filed Jul. 8, 2003, the disclosure of which is incorporated herein by reference.

TECHNICAL FIELD

The present invention relates to the drilling art and, more particularly, to an instrumented drill head for intended use in drilling boreholes or in installing roof anchors or bolts in the boreholes once formed.

BACKGROUND OF THE INVENTION

Heavy-duty drills using rotatable bits for penetrating into the earth enjoy widespread use. Recently, significant attention has been given to the use of feedback control to make the drilling operation more efficient, especially when drilling hard material (e.g., rock). By using such feedback control, the drilling operation can be continuously monitored and adjusted to ensure that the correct amount of thrust is applied or the rotational speed of the drilling element (bit) is maintained at the most efficient level to maximize the material removed per revolution, to avoid unnecessary grinding of the material, and to extend the service life of the bit. Examples of such feedback control systems can be found in commonly assigned U.S. Pat. Nos. 6,216,800 and 6,637,522, the disclosures of which are incorporated herein by reference. As an adjunct to sensing or measuring the thrust force and rotational speed, the torque acting on the drill bit can also be estimated and used to prevent overloading on the associated rotational motor.

A known manner of assessing the thrust acting on the drill bit and the rotational speed involves sensing or measuring characteristics of the hydraulic fluid used to power the drill. For example, the pressure in the fluid may be measured by a sensor (transducer) to obtain a signal proportional to the thrust acting on the drill bit. Likewise, the velocity of the hydraulic fluid flowing to the motor for rotating the bit may be measured using a sensor to obtain a signal proportional to the rotational speed. One or both "feedback" signals may then be used to monitor the drilling operation and make any adjustments necessary to maximize efficiency and extend the life of the drill bit.

In the past, the feed pressure and velocity sensors associated with the supply of hydraulic fluid to the drill head were "hardwired" to an input board. The input board transmitted the output signals over wires connected to a remote controller or computer elsewhere on the corresponding drilling machine for providing the desirable feedback control. In the harsh environment where earth (e.g., rock or coal) drilling usually takes place (e.g., in underground mines), the wiring is readily susceptible to being damaged. Even minor damage may render the feedback control totally useless.

A more conventional manner of measuring the rotational speed employs sensors mounted external on the drill head adjacent to the bit to measure physically the rotational speed or the thrust acting on it. However, such sensors must be calibrated frequently to compensate for machine variances. Like the fluid pressure and velocity sensors mentioned in the foregoing discussion, the external sensors are also susceptible to being damaged as the result of the conditions under which the drilling machine is typically used.

Accordingly, a need is identified for one or more embodiments of an instrumented drill head that eliminate the foregoing limitations and problems, either singularly or collectively.

SUMMARY OF THE INVENTION

In accordance with one aspect of the invention, an instrumented drill head for intended use with a drilling machine is disclosed. The drill head comprises a case including a rotatable chuck for receiving a drilling element, such as a drill bit. A first sensor carried by the case senses and generates an output signal representative of a first parameter of the drilling operation. A transmitter wirelessly transmits the output signal to a receiver associated with the controller.

In one embodiment, the first parameter is a torque level on the drilling element. In that situation, the first sensor includes a shear pin associated with a load cell for measuring a force acting on the shear pin, and the output signal represents the force acting on the shear pin. The shear pin may pass through a mounting plate associated with a housing of a motor for rotating the drilling element. An actual torque level on the drill bit is estimated using the force acting on the shear pin and a distance between the shear pin and the approximate center of a drive gear for driving the drill bit.

In another embodiment, the first parameter is a level of thrust acting on the drilling element. Consequently, the first sensor is a load cell for measuring this thrust level. The load cell may be associated with the rotatable chuck for receiving the drilling element.

In still another embodiment, the first parameter is a rotational speed of the drill bit. In such case, the first sensor may be an inductive proximity sensor. The sensor may be mounted for sensing the passing teeth of a drive gear in the case for driving the drill bit.

In any of the above embodiments, the first sensor is preferably mounted internal to the drill head. Moreover, where the first parameter is a torque level and the first sensor comprises a shear pin and a load cell for measuring the force acting on the shear pin, the drill head may further include: (1) a second sensor for measuring the thrust level acting on the drilling element and generating a second signal; (2) a third sensor for measuring the rotational speed of the drilling element and generating a third signal. When these additional sensors are present, the transmitter also transmits the second and third signals to a controller mounted separate from the drill head for controlling the drilling operation (or, alternatively, a roof bolting operation).

The drill head may further include a position sensor for generating a position signal representative of a relative position of the drilling element. Preferably, the transmitter transmits the position signal to the receiver. The position sensor may be external to the drill head.

In accordance with a second aspect of the invention, an apparatus including an instrumented drill head for performing a drilling or bolting operation using a drill bit or roof bolt is disclosed. The drill head comprises a case having an interior and an exterior. A first sensor positioned in the interior of the case senses and generates an output signal representative of a first parameter of the drilling operation. A controller separate from the case controls the drilling operation based at least in part on the first parameter. The controller includes a receiver, and a transmitter wirelessly transmits the output signal to the receiver.

In accordance with a third aspect of the invention, an apparatus for performing a drilling or bolting operation using a drill bit or roof bolt is disclosed. The apparatus includes a drill head having a rotatable chuck. A first sensor senses and generates an output signal representative of a first parameter of the drilling operation. A controller controls the drilling operation based at least in part on the first parameter. A transmitter wirelessly transmits the output signal to the controller.

The inventions described above may be used as part of a drilling machine. The machine may further include a mast for supporting the drill head such that the drilling element may be advanced toward and away from the material being drilled. Alternatively, a roof bolting machine may include the drill head, as well as an inserter for inserting resin in a borehole. The inserter may include a first end for receiving a resin cartridge and a second end for insertion in a chuck associated with the drill head.

In accordance with a fourth aspect of the invention, an instrumented drill head intended for use with a drilling machine having a drilling element for penetrating the earth is disclosed. The drill head comprises a case including a rotatable chuck for receiving the drilling element. A sensor associated with the case senses and generates an output signal representative of a parameter of the drilling operation. The sensor is selected from the group consisting of a shear pin associated with a first load cell for sensing the torque acting on a mounting plate associated with a motor for rotating the drilling element, a second load cell for sensing the thrust level acting on the drilling element, and an inductive proximity sensor for sensing the passing teeth on a drive gear for driving the drilling element.

In accordance with a fifth aspect of the invention, a method of remotely transmitting information regarding a drilling operation using a drill head including a rotatable chuck for receiving a drilling element is disclosed. The method comprises associating a first sensor with the drill head for sensing and generating an output signal representative of a first parameter of the drilling operation and providing a receiver separate from the drill head for receiving the output signal. The sensor and receiver are not connected to each other by wires.

In accordance with a sixth aspect of the invention, a method of evaluating a drilling or roof bolting operation using a drill head including a chuck for receiving and supporting a removable drilling element or roof bolt is disclosed. The method comprises sensing and generating an output signal representative of a first parameter of the drilling operation and wirelessly transmitting the output signal to a receiver separate from the drill head. The method may further comprise one or more of the following steps: (1) controlling the feed rate or rotational speed of the drilling element based on the output signal; (2) forming a plurality of boreholes using the drill head and mapping earth conditions based on the output signals obtained during the forming step; (3) indicating when the output signal represents unfavorable drilling or operating conditions; or (4) regulating the drilling operation based on the output signal to maximize the penetration and minimize wear on the drilling element depending on the type of material encountered.

BRIEF DESCRIPTION OF THE DRAWING FIGURES

Figure 2:
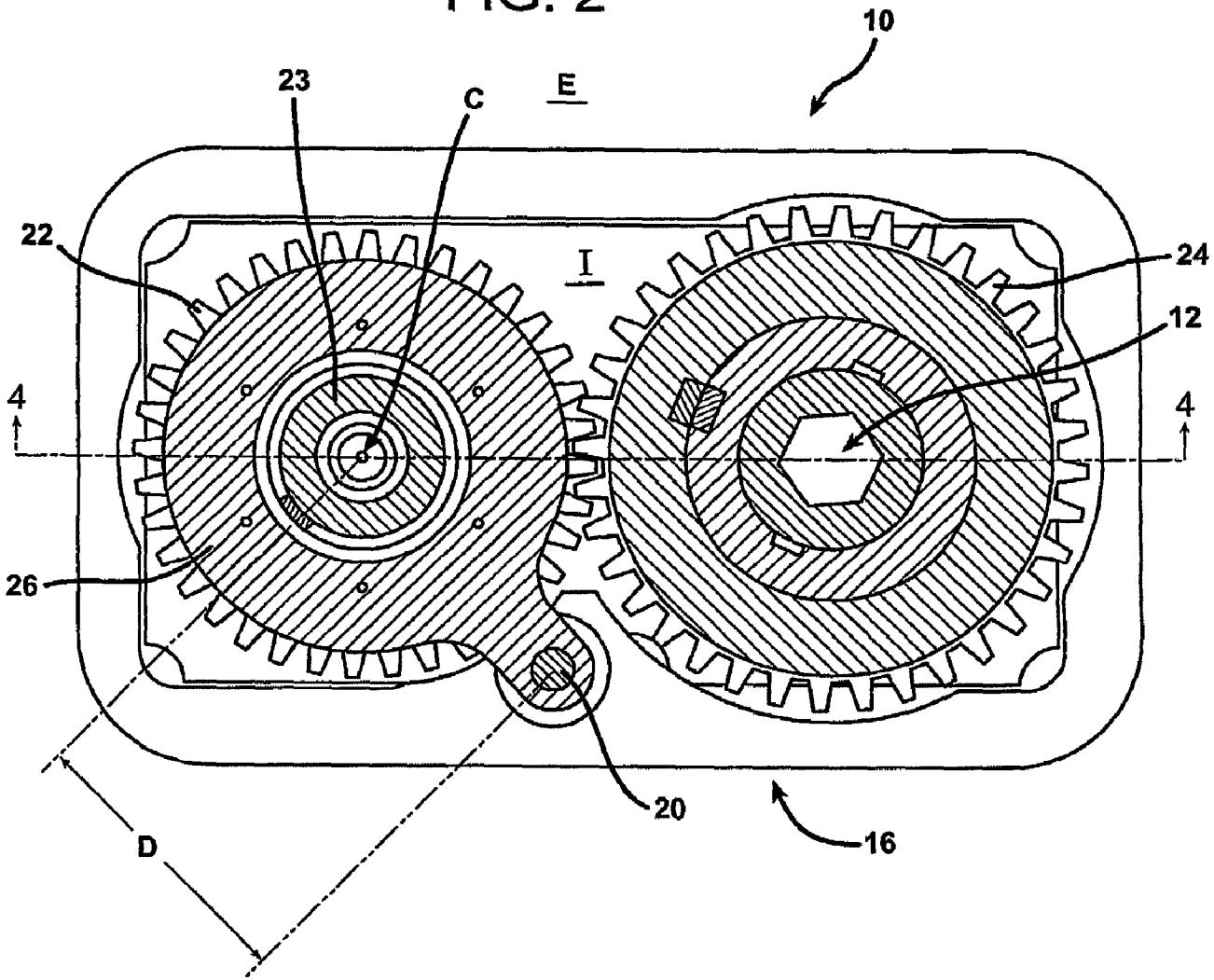
FIG. 2 is a partially cross-sectional top view of the drill head of FIG. 1.
Figure 2A:
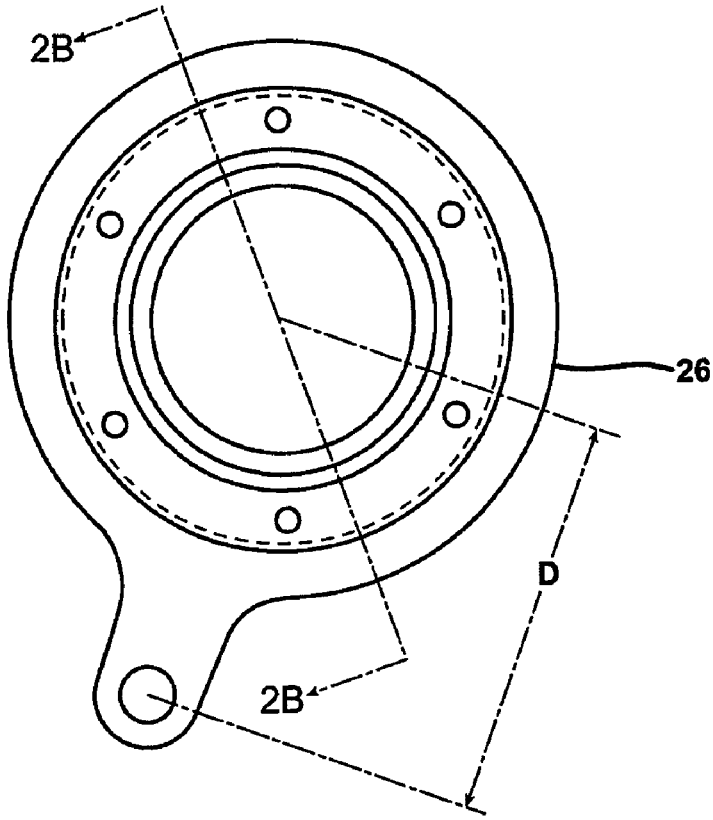
Figure 2B:
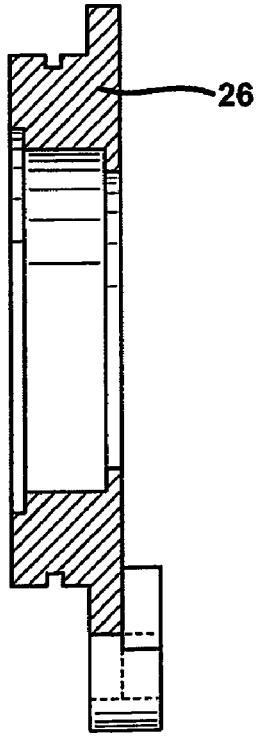

FIG. 2*a* is a side view of one embodiment of a mounting plate for a shear pin;

FIG. 2*b* is a partially cross-sectional side view of the shear pin mounting plate of FIG. 2*a;*

Figure 1:
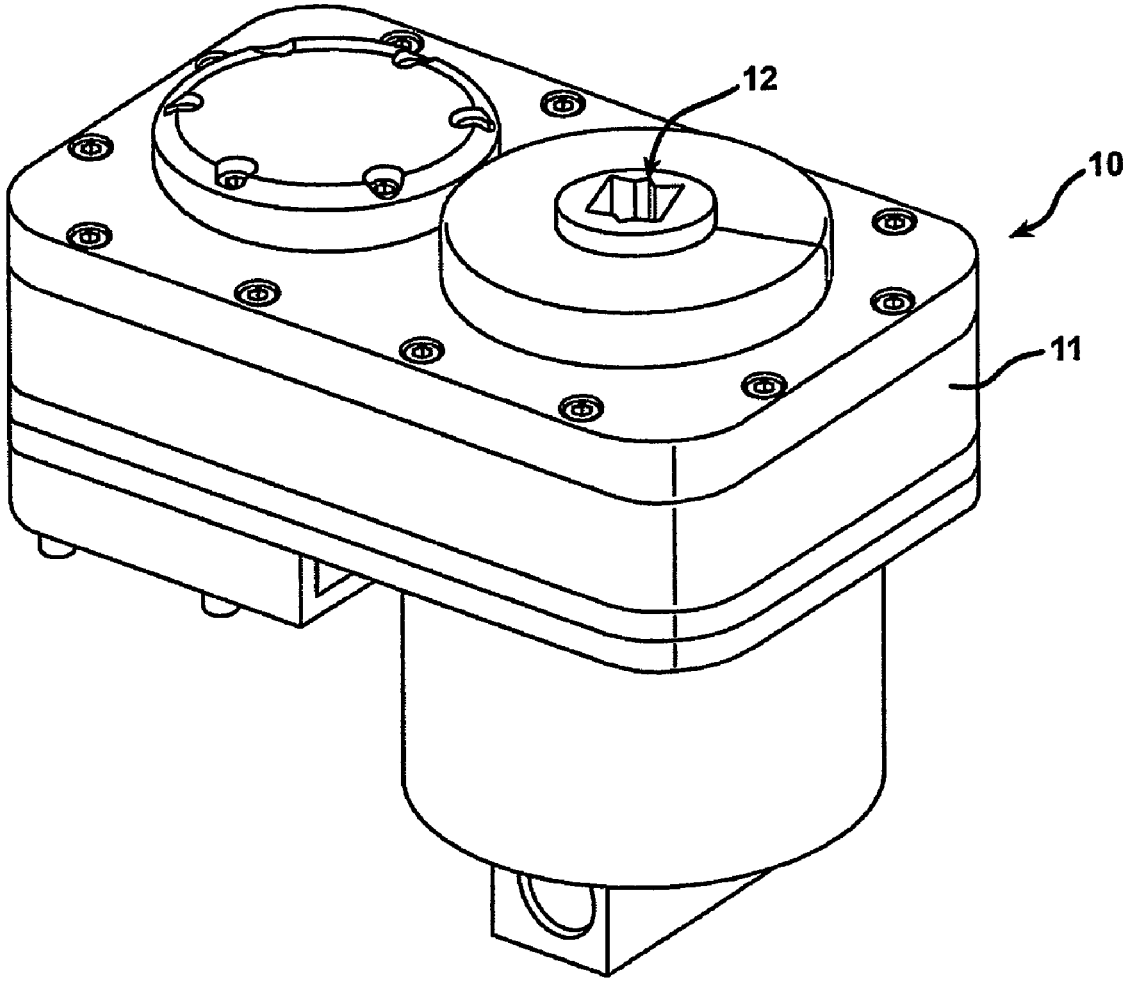
FIG. 1 is a perspective view of a drill head forming one aspect of the present invention.
Figure 3:
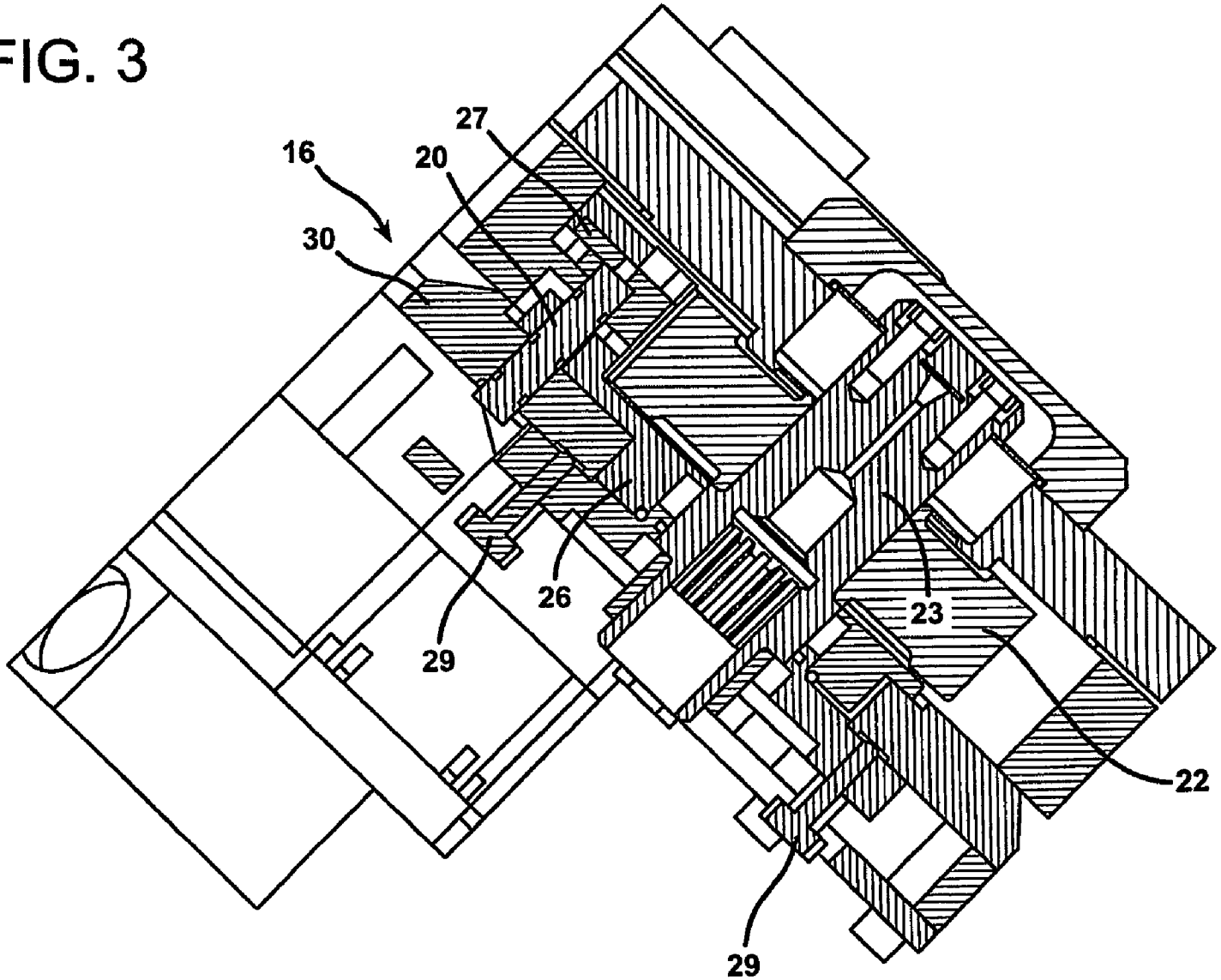
Figure 4:
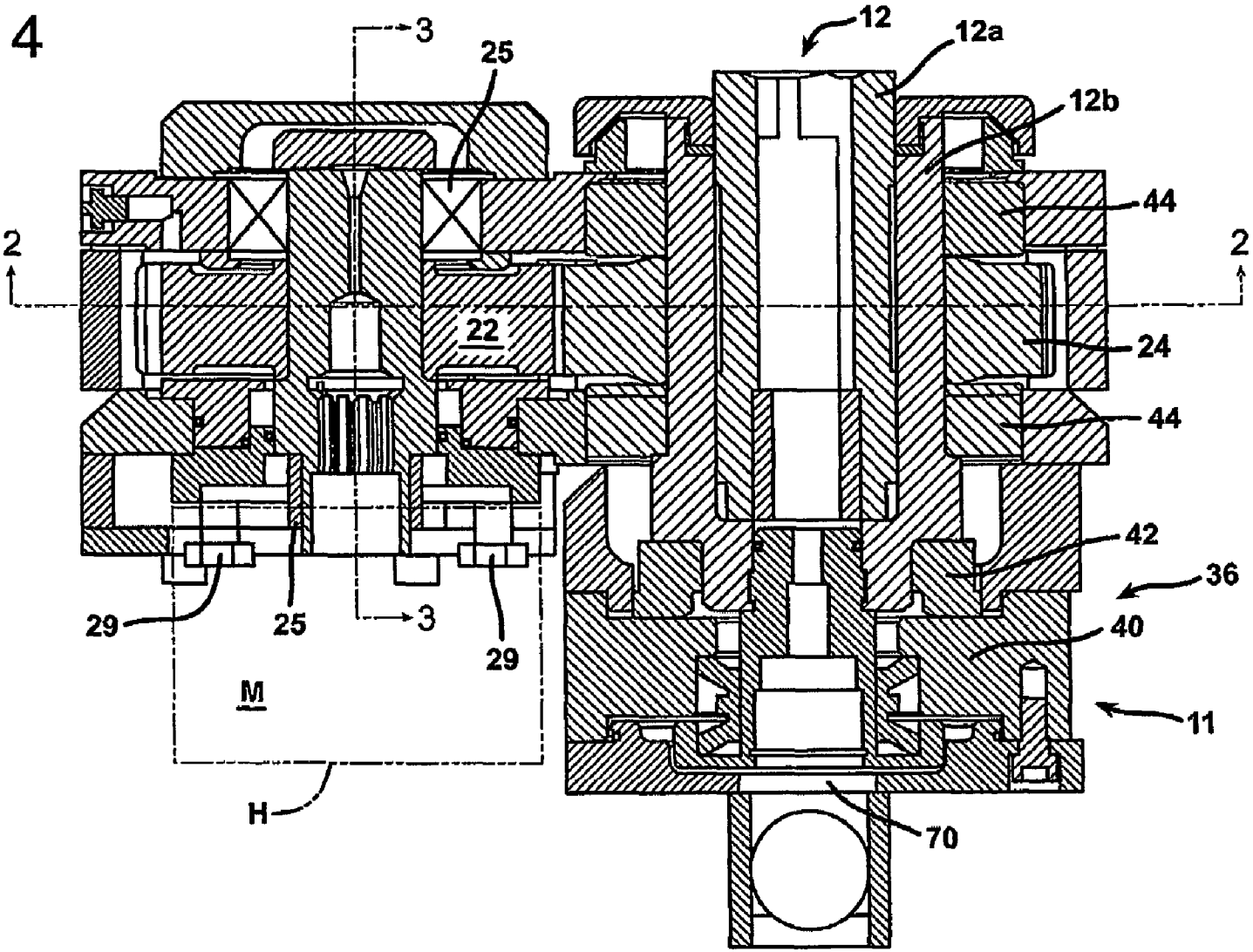
Figure 4A:
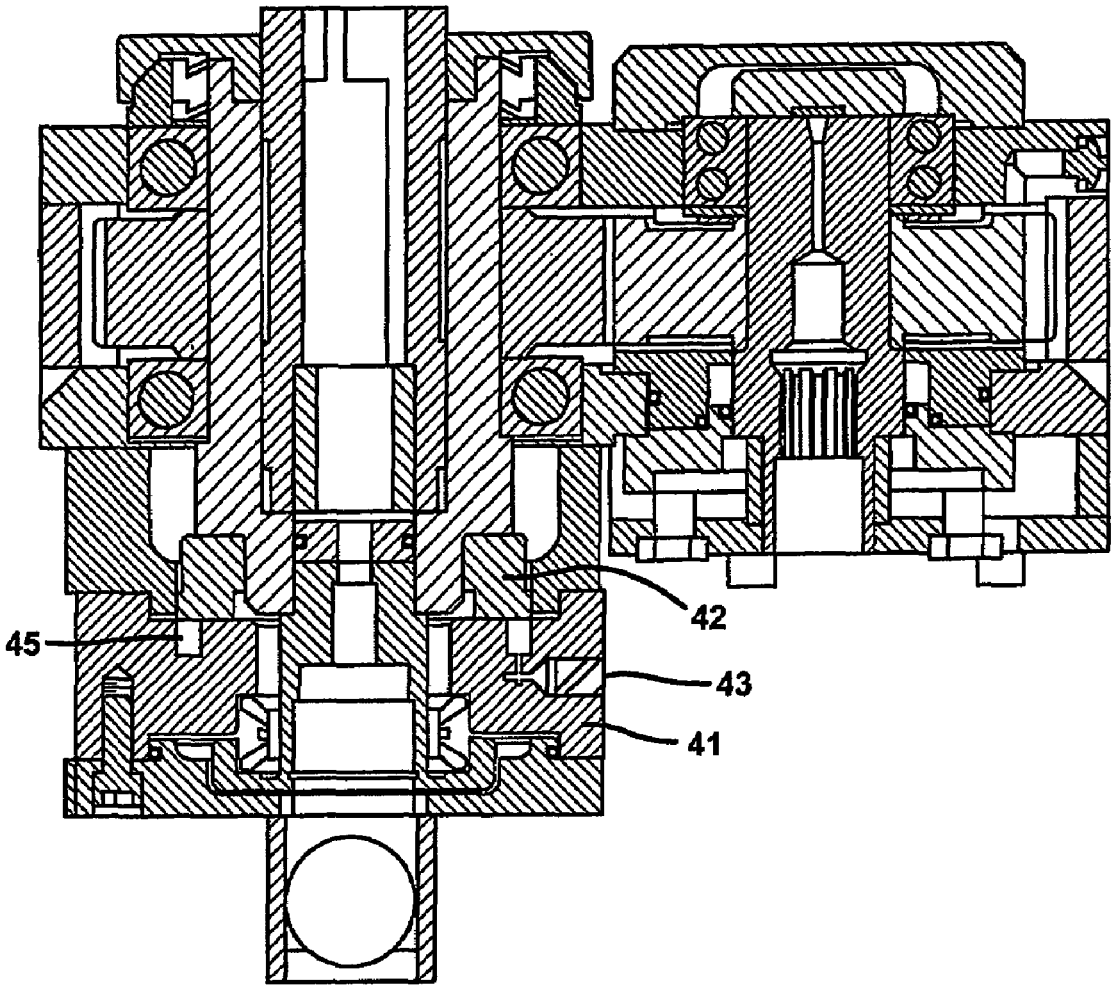
Figure 5:
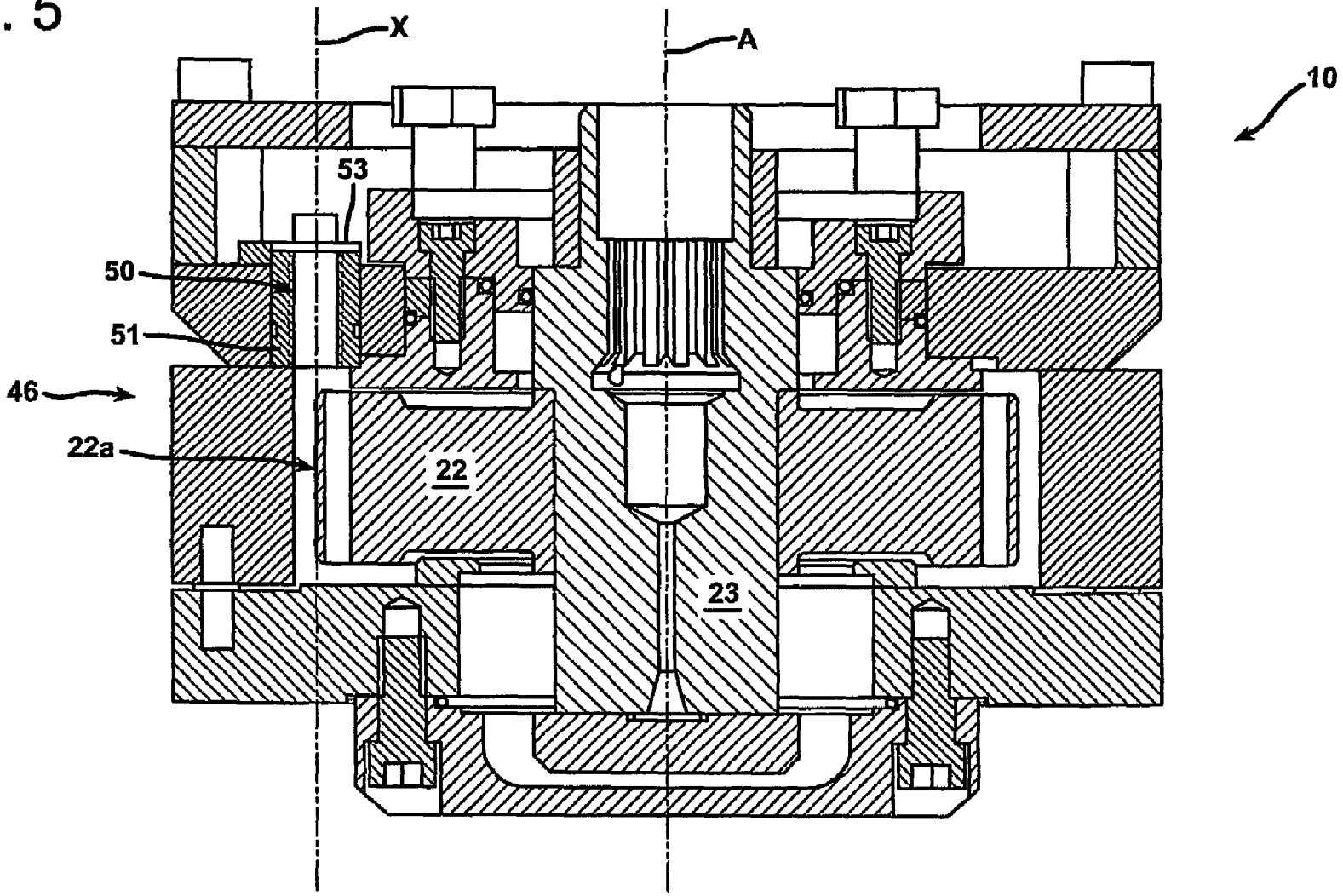
Figure 5A:
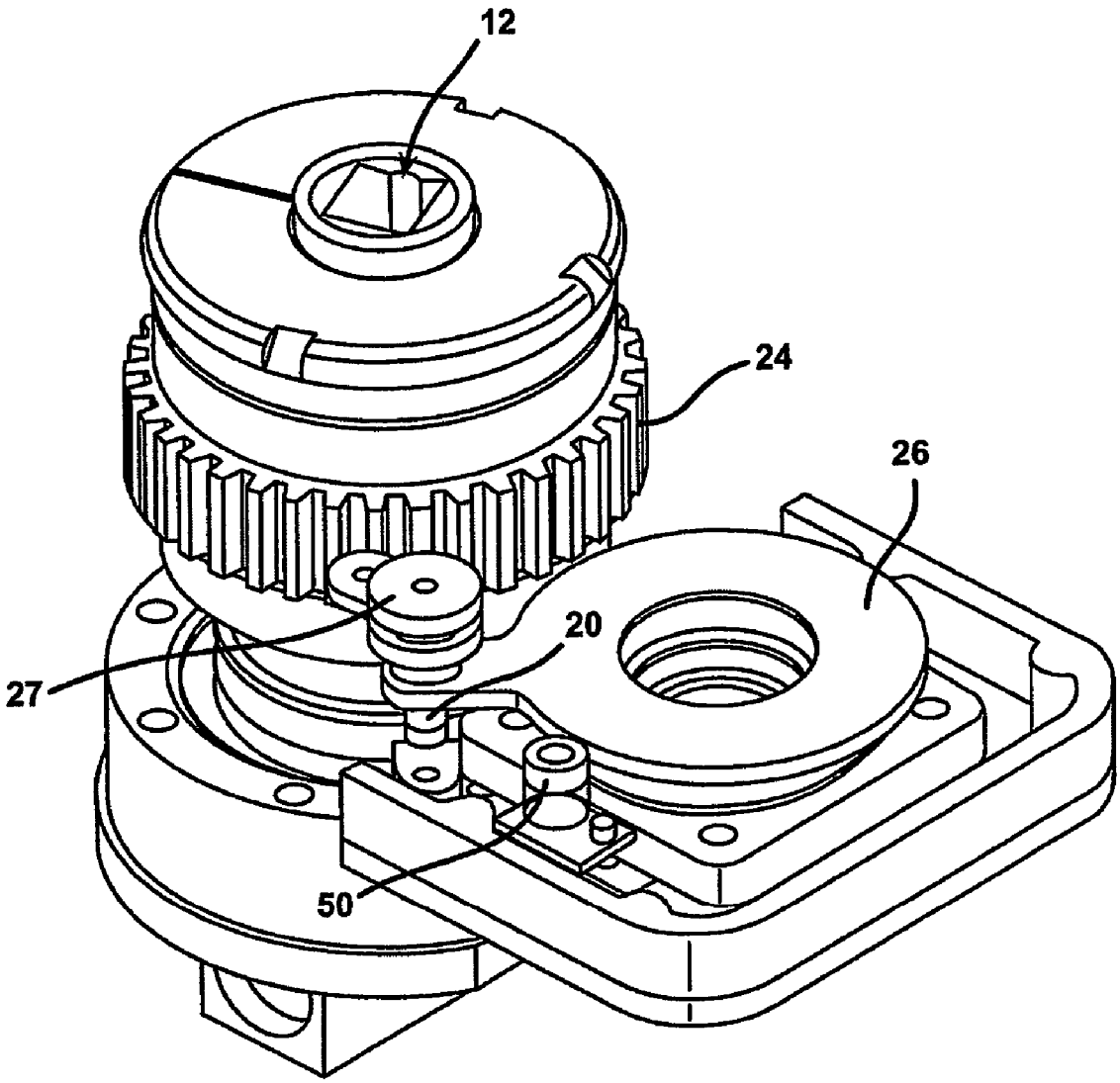
Figure 5B:
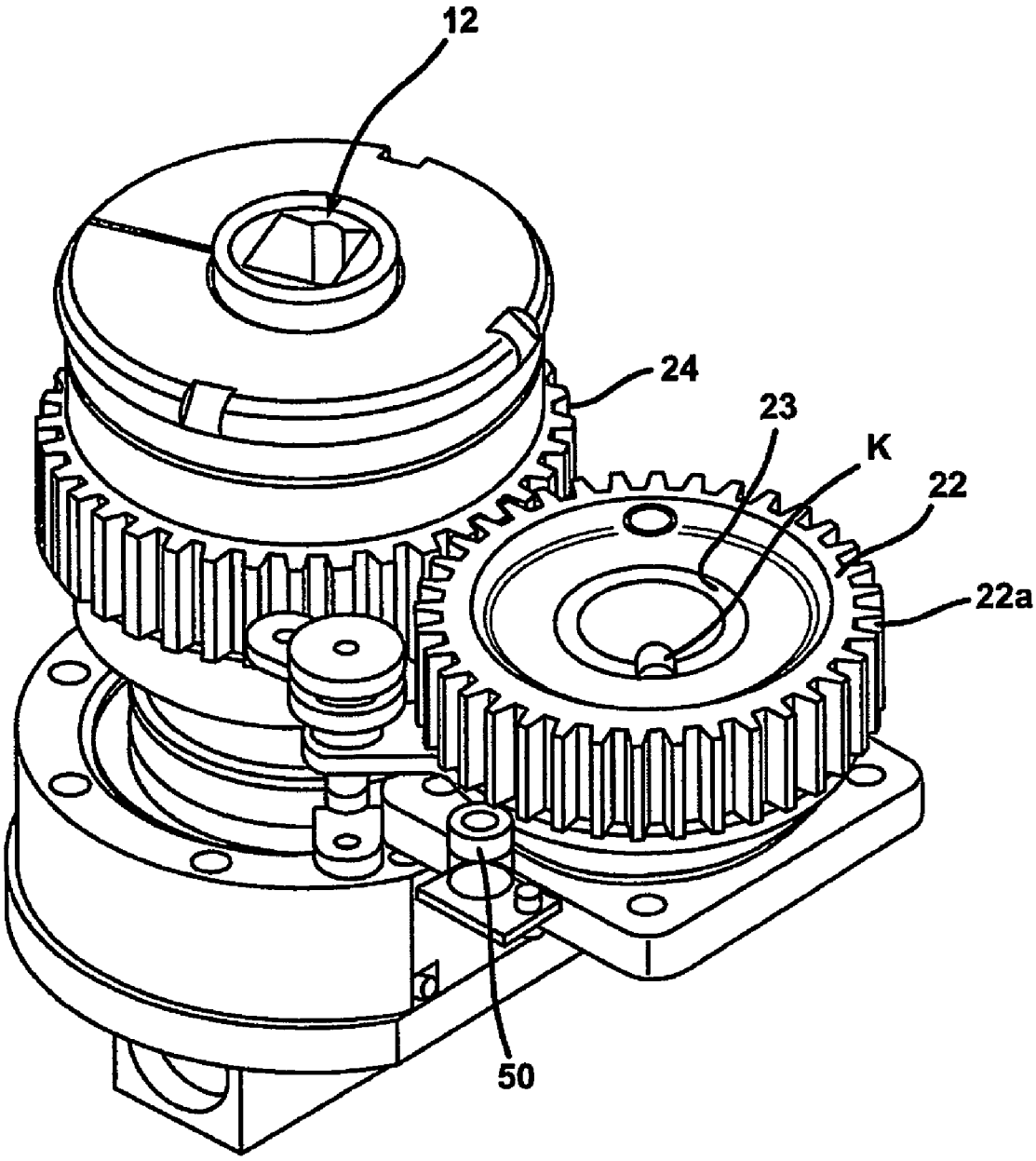
Figure 6:
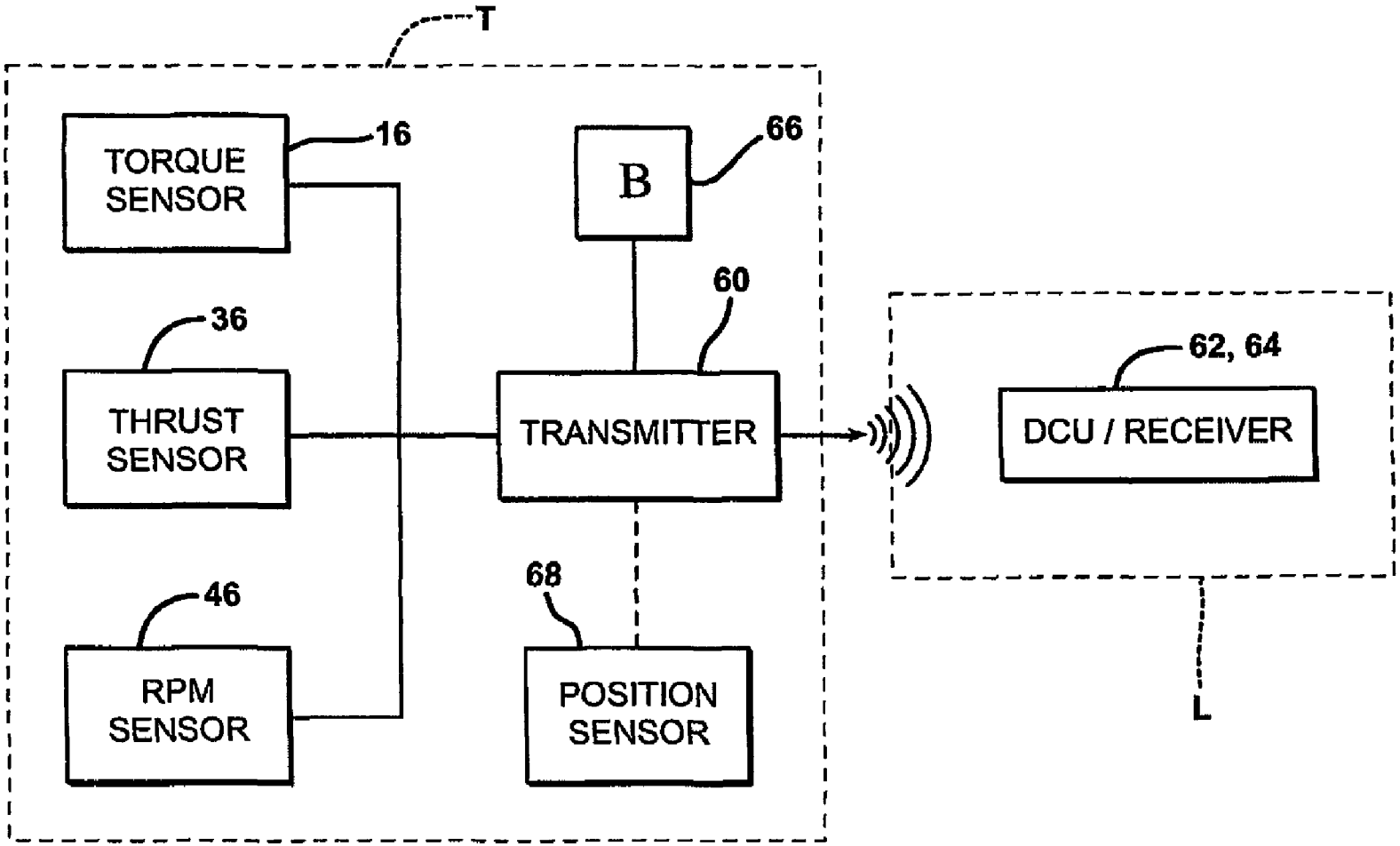
Figure 7:
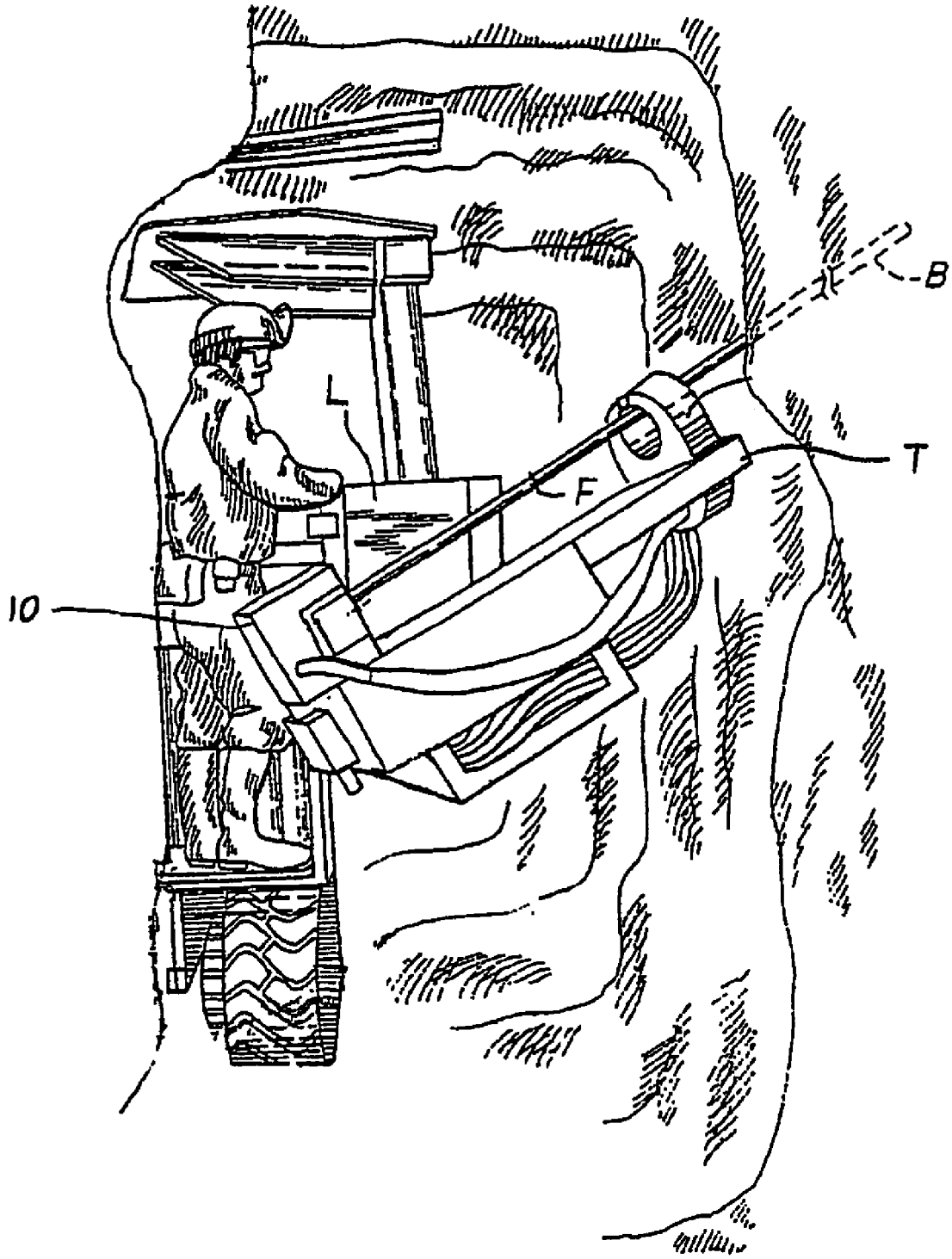
Figure 8A:
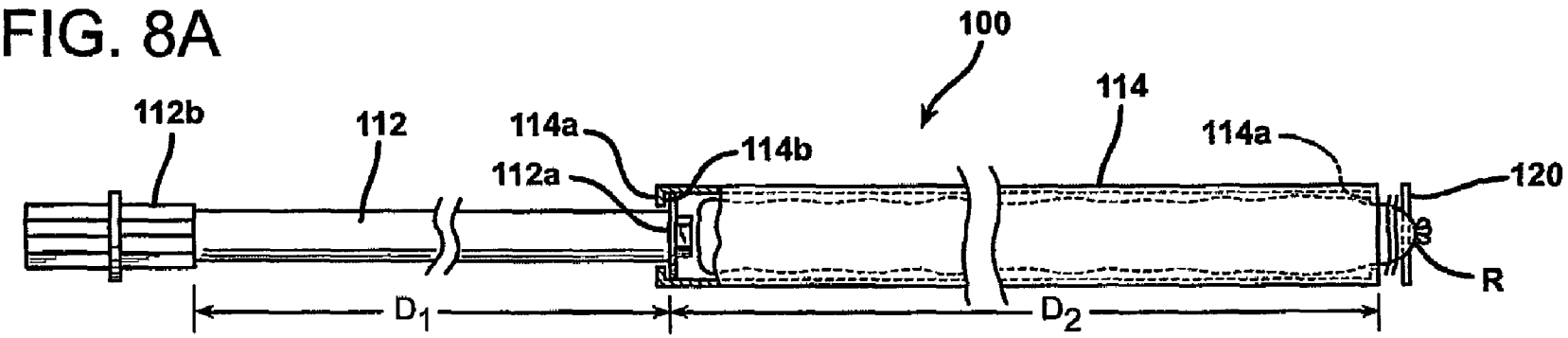
Figure 8B:
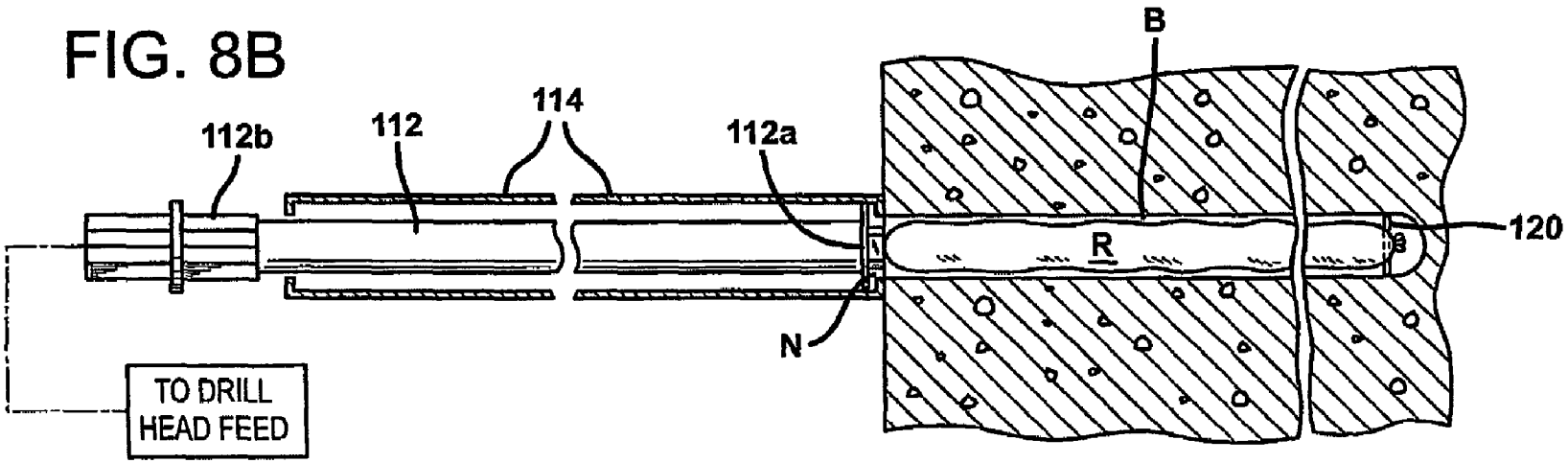

FIG. 3 is a partially cross-sectional side view taken along line 3-3 in FIG. 4;

FIG. 4 is a cross-section taken along line 4-4 in FIG. 2;

FIG. 4*a* is a cross-sectional view illustrating an alternate embodiment of a thrust sensor;

FIG. 5 is a cross-sectional view of the drill head of FIG. 1;

FIG. 5*a* is a partially cutaway perspective view of the drill head of FIG. 1;

FIG. 5*b* is another partially cutaway perspective view of the drill head of FIG. 1;

FIG. 6 is a schematic diagram illustrating one possible embodiment of a drilling machine including the inventive aspects disclosed herein;

FIG. 7 illustrates a drilling machine including a drill head associated with a mast for use in an underground mine environment;

FIG. 8*a* is a side schematic view of one possible embodiment of a resin inserter; and FIG. 8*b* illustrates the use of the resin inserter of FIG. 8*a* for inserting a resin cartridge into a borehole.

DETAILED DESCRIPTION OF THE INVENTION

Reference is now made to FIG. 1, which illustrates a drill head 10 such as for use on a rock drilling machine (not shown). The rock drilling machine may be of the type used for both forming boreholes in the passageways of underground mines and then installing roof bolts in the boreholes to provide support for the adjacent mine face (see FIG. 7). Various types of such machines are well-known in the art.

The drill head 10 includes a body, housing, or case 11 having an interior I (and thus defining an exterior E; see FIG. 2). A rotatably mounted or supported receiver (chuck) 12 associated with this case 11 receives the distal end of a wrench or socket (not shown). In one possible mode of operation, the wrench or socket in turn receives a drilling element, such as a steel and bit (or drill "string" not shown, but all hereinafter collectively referred to as the drill "bit") for penetrating into the earth to form the borehole. Any type of conventional drill bit will work, with a preference for those capable of drilling narrow width (less than 2") boreholes in rock, coal, and like materials. Although the chuck 12 in FIG. 1 has a generally square cross-section, other shapes may be used as well (see, e.g. FIG. 2), depending on the particular application.

Feed for the drill head 10 and hence the bit to form the borehole may arise from an adjacent linearly reciprocating structure (not shown). This structure may be of any conventional type (e.g., a mast T having sliders, rods, or C-channels along which the drill head translates to-and-fro relative to the face of the mine passage; see FIG. 7). As is known in the art, a position sensor (not shown) establishes the position of the drill bit relative to the mast during the drilling operation (and, as will be understood upon reviewing the description that follows, may generate an output signal sent via transmitter to a remote drill control unit including a complimentary receiver separate from the drill head 10).

With reference now to FIGS. 2, 3 and 4, the drill head 10 includes an internally mounted or positioned torque sensor 16 (that is, positioned in the interior I of the body or case 11). In one embodiment, the torque sensor 16 comprises an "instrumented" shear pin 20 associated with a drive gear 22 supported by and connected to a drive shaft 23 (such as by way of a key K; see FIG. 5*b*). Suitable bearings support the drive shaft 23 (including thrust and ball bearings 25, see FIG. 4). This shaft 23 couples via a splined interface to the output shaft of a motor M (such as a two-speed hydraulic motor capable of achieving approximately 660 rpm at 20 GPM in a high speed mode and approximately 400 ft-lb of torque in a low speed mode (e.g., an Eaton 2000 Series Model No. 106-2005)). The drive gear 22 intermeshes with and operatively engages a driven gear 24 also positioned in the body or case 11. By way of a key, spline, or like secure connection, the driven gear 24 attaches to the chuck 12 for receiving the drill bit.

In the illustrated embodiment, the shear pin 20 is elongated and positioned in an opening in a mounting plate 26 (see FIGS. 2*a* and 2*b*). One end of the shear pin 20 associates with a support bracket or mounting part 27. A force measuring device or transducer is also associated with the shear pin 20. In the preferred embodiment, this transducer comprises a load cell that measures the actual loading experienced by the shear pin 20 (and thus may be associated with the shear pin 20 itself, a plate 30 receiving one end of the shear pin 20, or the mounting part 27). In any case, the load is transmitted to the shear pin 20 by the mounting plate 26, which is connected to the housing H of the motor M via bolts 29 (see FIG. 4), but not the body or case 11 of the drill head 10. As a result, the motor housing tends to be urged in a direction opposite the rotation of the corresponding output shaft, which urges the mounting plate 26 into engagement with the shear pin 20.

Based on the distance D from the center of the drive gear 22 (which may be approximate) to the shear pin 20 and the load acting on the load cell, the torque experienced by the motor M may be estimated. This estimated torque is directly proportional to the torque acting on the drill bit, bolt, or other structure positioned in the chuck 12 and being rotated. As should be appreciated, using this torque sensor 14 instead of a fluid pressure transducer eliminates the potential hose losses and motor inefficiencies that otherwise skew the calculation.

As perhaps best shown in FIG. 4, a second sensor 36 measures the thrust acting on the drill bit. In the preferred embodiment, the thrust sensor 36 comprises a second load cell 40 positioned adjacent the chuck 12 for receiving the drill bit, also in the interior I of the body or case 11. More particularly, in the illustrated preferred embodiment, this second load cell 40 is mounted in direct contact with a thrust bearing 42 supporting the chuck 12. The chuck 12 (which as illustrated in FIG. 4 may be comprised of a generally hollow inner component 12*a* for receiving the drill bit and an outer component 12*b* connected or attached thereto) is in turn supported by a pair of spaced bearing assemblies 44, which preferably each include a plurality of ball bearings. This arrangement ensures that the thrust force acting on the drill bit in the chuck 12 is isolated from the other components of the drilling force, and thus reduces the influence of external forces, the inefficiencies of the hydraulic system, and the mechanical forces for moving the drill head 10.

An alternative embodiment of a thrust sensor is shown in FIG. 4*a*. In this embodiment, the load cell is eliminated in favor of a closed hydraulic cylinder ring 41. Hydraulic fluid is fed through an inlet 43 to an annular channel 45 formed in the ring 41 adjacent the thrust bearing 42. Measuring the pressure of the fluid thus gives an indication as to the thrust acting on the drill bit.

A third sensor 46 measures the rotational speed of the drill bit. In the preferred embodiment, the third sensor 46 comprises an inductive-type proximity sensor 50 mounted adjacent to one of the drive gear 22 or the driven gear 24. As illustrated in FIG. 5 (in which the drill head 10 is shown upside-down) and FIG. 5*b*, this proximity sensor 50 is positioned adjacent to the periphery of the drive gear 22 and is oriented with a direction of sensing X (as defined by an elongated barrel 51) generally parallel to the axis of rotation A. As noted further below, the detection face 53 is spaced from the drive gear 22 a specific distance in the axial direction.

As is known in the art, an exemplary inductive proximity sensor generates a magnetic field from its detection face. Whenever a detectable object moves into the sensor's field of detection, eddy currents build up in the target and dampen the sensor's magnetic field. This effect triggers the output signal. In this embodiment, the proximity sensor 50 thus effectively "sees" the passing teeth 22*a* of the drive gear 22 as it rotates. Using the output signal from the sensor 50 and the known number of teeth on the drive gear 22, the number of revolutions per minute can be calculated. Likewise, based on the known number of teeth on the driven gear 24, the rotational speed of the chuck 12 and hence the drill bit may be determined (such as by a drill control unit; see below). An exemplary, MSHA approved inductive proximity sensor is Gilson No. B12-G12-YOX-7M with a 12 millimeter barrel and a 2 millimeter sensing range. Instead of sensing the teeth on the drive gear 22, it should also be appreciated that the sensor 46 could also be positioned adjacent to the driven gear 24 to obtain a similar reading and eliminate the need for a conversion. Moreover, instead of sensing the teeth on either gear 22 or 24, the third sensor 46 could be used to detect the passing of another indicia (such as a hole provided in the gear or a projection extending from it).

As shown in the block diagram of FIG. 6, the output of each sensor 16, 36, 46 is coupled to at least one transmitter 60 located on or in the drill head 10 (which may be supported on the mast T). In the preferred embodiment, the transmitter 60 modulates and sends radio frequency signals representative of the parameters of the drilling operation being measured to a drill control unit (DCU) 62 including a suitable receiver 64 for receiving the transmitted signals. In the preferred embodiment, the arrangement is thus considered "wireless" in the sense that no external cables or lines are required on the exterior E of the drill head 10.

The DCU 62 may be mounted on the boom (not shown) supporting the mast T and drill head 10 or elsewhere on the drilling machine L. The transmitter 60 may be programmed to communicate only with the corresponding DCU 62. This prevents it from interfering with any adjacent DCU's or radio-controlled devices.

Since elimination of the wires normally provided between the drill head 10 and the DCU 62 is desirable, the transmitter 60 and the associated sensors 16, 36, 46 are preferably powered by an onboard battery 66. The sensors 16, 36, 46 are preferably of a type requiring minimum power consumption to extend the battery life. Although optional, use of a single transmitter 60 for transmitting all three output signals generated by the sensors 16, 36, 46 (and possibly the signal from an external position sensor 68) in the preferred embodiment further reduces the power requirements.

As described in commonly assigned U.S. Pat. Nos. 6,216,800 and 6,637,522, the DCU 62 may be programmed to perform or provide feedback control of the drilling operation based on the outputs of the sensors 16, 36, 46. In particular, the feed rate and rotational speed of the drill bit may be regulated by the DCU 62. In most cases, the goal is to ensure the maximum penetration per revolution of the drill bit depending on the type of material encountered (hard vs. soft), as well as to reduce the feed rate and speed when harder materials are encountered to maximize bit life. Likewise, the torque measurement may also be used to control the drilling operation or to cut-off the motor to prevent a catastrophic drill bit failure.

The operating conditions reported or determined may also be used to obtain a map of the drilling environment, including the identification of different layers of strata adjacent to the borehole, the relative distance of each layer from the bore hole entry point, and any voids present. In the underground environment, the identification of a void may alert the drill operator to exercise caution in view of potentially unstable roof conditions, or allow for the development of a roof control plan to accommodate detected potential weaknesses in the overburden.

While the focus of the foregoing discussion is on using the drill head 10 for drilling a borehole, it should also be appreciated that the output signals generated by one or more of the sensors may be used during a subsequent roof bolting operation. For example, the remotely transmitted torque, rotational speed, or position outputs can be used to monitor and control an automated sequence for installing a roof bolt (see FIG. 7 and note roof bolt F ready for installation in borehole B formed in the "rib," or vertical sidewall, forming part of a passageway in an underground mine). Before installation, an automated means for inserting resin into the borehole B (such as a resin injector or other structure for holding resin cartridges or "sausages" and a source of a driving fluid for supplying the resin to the borehole once formed by fluid pressure) before installing the roof bolt may also be employed (see, e.g., U.S. Pat. Nos. 4,229,124 and 6,135,674, the disclosures of which are incorporated herein by reference). Alternative approaches involve use of a resin inserter described below and shown in FIGS. 8*a* and 8*b*, or the wand shown in commonly assigned U.S. Pat. No. 5,951,208, the disclosure of which is also incorporated herein by reference.

As perhaps best shown in FIG. 4, the drill head 10 may also include an inlet 70 for receiving a flow of bailing fluid, such as water or air. In the typical arrangement the fluid is passed through a channel in the drill bit into the borehole to flush away dust and cuttings. The cuttings and dust are filtered and collected for later disposal.

An exemplary resin inserter 100 is shown in FIGS. 8*a* and 8*b*. In this embodiment, the inserter 100 includes a body comprising a first portion 112 telescopingly received in a second, tubular portion 114. The second portion 114 includes an annular lip 114*a*, 114*b* at each end defining an opening. The first portion 112 includes an oversized head 112*a*, which may be unitary or defined by a separate washer having a diameter greater than the second portion and held in place using a fastener such as a bolt. Although capable of moving to and fro, the first portion 112 is thus effectively connected to the second portion 114.

At a first end of the first portion 112 of the body of the inserter 100, an oversized adaptor 112*b* is provided. The adaptor 112*b* is adapted for insertion in the chuck 12 or socket of the drill head 10, and is generally oversized such that it is prevented from passing through the opening defined by the annular lip 114*b* (which may be unitary or defined by a separate component fastened to the second portion 114). The distance $D_1$ from the end of the adaptor 112*b* closest to the second portion 114 of the body to the oversized head is preferably at least as great as the distance $D_2$ from the inside surface of annular lip 114*b* to the inside surface of annular lip 114*a*. This ensures that the first portion 112 (which is effectively a piston) can travel or "stroke" the complete length of the second portion 114 (which is effectively a cylinder for receiving the piston) when the inserter 100 is compressed.

In operation, a resin cartridge R may first be inserted in the tubular second portion 114 through the opening adjacent the annular lip 114*a* at the delivery end. The cartridge R may be held in a suspended condition in the inserter 100 by a retainer, such as a pin 120 or piece of wire. The inserter 100 is then positioned with the adaptor 112*b* in the chuck 12 or socket of the drill head 10 and the opposite end in any drill guide or like structure present. The opposite end of the inserter 100 is then positioned adjacent to the entrance N of the borehole B. Alternatively, the exposed end of the cartridge R may be inserted into the borehole B before associating the inserter 100 with the drill head 10.

Once in position, the feed of the mast T associated with the drill head 10 is used to stroke the first portion 112 or "piston" forming part of the body of the inserter 100 (see FIG. 8*b* and note the fully extended and fully compressed positions). The oversized head 112*a* thus engages the adjacent end of the resin cartridge R and drives or pushes it through the tubular passageway (which is typically aligned with the direction of gravity) and out the delivery end of the inserter 100. This introduces the cartridge R into the borehole B, at which point the drill head feed may be reversed to draw the inserter 100 away from the entrance N. The inserter 100 is then withdrawn and the roof bolt F or other anchor may be inserted in the chuck 12 or socket of the drill head 10 (see FIG. 7). The drill head feed is then used to install the bolt or anchor in the borehole B, which ruptures the previously installed resin cartridge R. The bolt F or anchor may then be spun using the drill head 10 to mix the resin, which upon setting provides the desired roof support.

The foregoing descriptions of various embodiments of the disclosed inventions are provided for purposes of illustration, and are not intended to be exhaustive or limiting. Modifications or variations are also possible in light of the above teachings. For example, any one of the sensors alone could be used with a single transmitter, or all sensors could be coupled to different transmitters (although this may be less desirable in terms of power consumption, which may be an important consideration in underground mining operations). Moreover, sensors besides the one shown (e.g., transducers) could be used to generate the output signals transmitted wirelessly to the receiver. In an alternative embodiment of the resin inserter 100, a one-piece, non-telescoping tube receives the resin cartridge R at one end and fluid (e.g., water or air) emanating from the drill head 10 at the other. The fluid moves the resin cartridge R through the delivery end into the borehole B. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. An instrumented drill head for intended use with a drilling machine having a drilling element for penetrating the earth and a receiver for receiving information relating to the drilling operation, comprising:

a case including a rotatable chuck for receiving the drilling element;

a first sensor carried by the case for sensing and generating an output signal representative of a first parameter of the drilling operation; and a transmitter for wirelessly transmitting the output signal to the receiver separate from the case.

2. The drill head according to claim 1, wherein the first parameter is a torque level on the drilling element, the first sensor includes a shear pin associated with a load cell for measuring a force acting on the shear pin, and the output signal represents the force acting on the shear pin.

3. The drill head according to claim 2, wherein the shear pin passes through a mounting plate associated with a housing of a motor for rotating the drilling element.

4. The drill head according to claim 2, wherein an actual torque level on the drilling element is estimated using the force acting on the shear pin and a distance between the shear pin and the approximate center of a drive gear for driving the drilling element.

5. The drill head according to claim 1, wherein the first parameter is a thrust level acting on the drilling element and the first sensor comprises a load cell for sensing the thrust level.

6. The drill head according to claim 1, wherein the first parameter is a rotational speed of the drilling element and the first sensor is an inductive proximity sensor for sensing the passing teeth on a drive gear for driving the tilling element.

7. The drill head according to claim 1, wherein the first sensor is internal to the case and separate from the drilling element.

8. The drill head according to claim 1, wherein the first parameter is a torque level on the drilling element and the first sensor comprises a shear pin and a load cell for sensing the force acting on the shear pin, and further including:

a second sensor for sensing the thrust level acting on the drilling element and generating a second signal;

a third sensor for sensing the rotational speed of the drilling element and generating a third signal; and wherein the transmitter also transmits the second and third signals to the controller.

9. The drill head according to claim 1, wherein the transmitter mounts on the drill head and a controller including the receiver mounts to a structure on the drilling machine separate from the drill head.

10. The drill head according to claim 1, further including a position sensor for generating a position signal representative of a relative position of the drilling element, wherein the position signal is transmitted to the receiver via the transmitter.

11. A roof bolter including the instrumented drill head of claim 1.

12. An apparatus for performing a drilling or bolting operation using a drilling element or roof bolt, comprising:

a drill head including a case having an interior and an exterior;

a first sensor positioned in the interior of the case for sensing and generating an output signal representative of a first parameter of the drilling operation;

a controller separate from the case for controlling the drilling operation based at least in part on the first parameter, said controller including a receiver; and a transmitter for wirelessly transmitting the output signal to the receiver.

13. The apparatus of claim 12, wherein the controller regulates one of a rotational speed or feed rate of the drilling element.

14. An apparatus for performing a drilling or bolting operation using a drilling element or roof bolt, comprising:

a drill head including a rotatable chuck for receiving the drilling element or roof bolt;

a sensor for sensing and generating an output signal representative of a first parameter of the operation;

a controller for controlling the operation based at least in part on the first parameter; and a transmitter for wirelessly transmitting the output signal to the controller.

15. The apparatus of claim 14, further including a mast for supporting the drill head such that the drilling element may be advanced toward and away from the material being drilled.

16. The apparatus of claim 14, further including an inserter for inserting resin in a borehole.

17. The apparatus of claim 16, wherein the inserter includes a first end for receiving a resin cartridge and a second end for insertion in the chuck.

18. An instrumented drill head intended for use with a drilling machine having a drilling element for penetrating the earth and a receiver for receiving information relating to the drilling operation, comprising:

a case including a rotatable chuck for receiving the drilling element;

a motor for rotating the drilling element;

a first sensor associated with the case for sensing and generating an output signal representative of a parameter of the drilling operation, wherein the sensor is selected from the group consisting of a shear pin associated with a first load cell for sensing the torque acting on a mounting plate associated with the motor for rotating the drilling element, a second load cell for sensing the thrust level acting on the drilling element, and an inductive proximity sensor for sensing the passing teeth on a drive gear for driving the drilling element; and a transmitter for wirelessly transmitting the output signal to the receiver.

19. A method of remotely transmitting information regarding a drilling operation using a drill head including a rotatable chuck for receiving a drilling element, comprising:

associating a first sensor with the drill head for sensing and generating an output signal representative of a first parameter of the drilling operation; and providing a receiver separate from the drill head for receiving the output signal, wherein the sensor and receiver are not connected to each other by wires.

20. The method of claim 19, further including controlling the feed rate or rotational speed of the drilling element based on the output signal.

21. The method of claim 19, it further including the steps of forming a plurality of boreholes using the drill head and mapping earth conditions based on the output signals obtained during the forming step.

22. The method of claim 19, further including indicating when the output signal represents unfavorable drilling or operating conditions.

23. The method of claim 19, further including regulating the drilling operation based on the output signal to maximize the penetration and minimize wear on the drilling element depending on the type of material encountered.

* * * * *